US005427219A

United States Patent [19]

Kotler

[11] Patent Number: 5,427,219

[45] Date of Patent: Jun. 27, 1995

[54] COIN GUIDING DEVICE

[75] Inventor: Martin Kotler, Douglas, Isle of Man

[73] Assignee: Mars, Incorporated, McLean, Va.

[21] Appl. No.: 70,432

[22] PCT Filed: Dec. 4, 1991

[86] PCT No.: PCT/GB91/02150

§ 371 Date: Jun. 3, 1993

§ 102(e) Date: Jun. 3, 1993

[87] PCT Pub. No.: WO92/10815

PCT Pub. Date: Jun. 25, 1992

[30] Foreign Application Priority Data

Dec. 4, 1990 [GB] United Kingdom ..... 9026376

[51] Int. Cl.[6] ..... G07F 1/04

[52] U.S. Cl. ..... 194/203; 194/346

[58] Field of Search ..... 194/203, 339, 340, 345, 194/346

[56] References Cited

U.S. PATENT DOCUMENTS

| | | | |
|---|---|---|---|
| 777,525 | 12/1904 | Long | 194/203 |
| 2,287,292 | 6/1942 | Bugg | 194/229 X |
| 2,708,499 | 5/1955 | Patzer . | |
| 3,837,454 | 9/1974 | Joeck | 194/318 |
| 4,243,133 | 1/1981 | Nicolaus | 194/203 |
| 4,298,116 | 11/1981 | Niemeyer | 194/203 |

FOREIGN PATENT DOCUMENTS

| | | |
|---|---|---|
| 2260220 | 6/1974 | Germany . |
| 3423367 | 1/1986 | Germany . |
| 0208850 | 7/1923 | United Kingdom . |
| 1328051 | 8/1973 | United Kingdom . |
| 1414184 | 11/1975 | United Kingdom . |
| 1482417 | 8/1977 | United Kingdom . |
| 2045499 | 10/1980 | United Kingdom . |
| 2122403 | 1/1984 | United Kingdom . |
| 2224150 | 5/1990 | United Kingdom . |

*Primary Examiner*—F. J. Bartuska

*Attorney, Agent, or Firm*—Davis Hoxie Faithfull & Hapgood

[57] ABSTRACT

A coin guiding device comprises a surface disposed normally in use in the path of a coin, and inclined downwardly toward one side of the path to cause coins which have engaged the surface to tend to move toward that side. The surface is moveable under the weight of the coin in a direction out of the plane of the coin to permit the coin to pass, and is so arranged that the effective leverage caused by the coin increases as the coin moves toward the side of the path.

16 Claims, 3 Drawing Sheets

COIN GUIDING DEVICE

FIELD OF THE INVENTION

This invention relates to coin guiding devices.

BACKGROUND OF THE INVENTION

It is well known to provide coin guiding devices for controlling the movement of coins along a coin path so as to render this movement more stable. This is particularly valuable in coin validators, wherein the measurement of the coin properties may be influenced if the coin's movement is erratic. Such devices, sometimes known as "snubbers", may take either an active or a passive form. In the passive form, the snubber may for example be made of hard material, and disposed so that a coin inserted into a validator impacts the snubber which thus absorbs much of the coin's energy so that the subsequent flight of the coin is fairly stable. An active snubber may take the form of a lever extending across the coin path, so that the engagement of the coin with the lever causes the lever to move cut of the path of the coin, thus again absorbing some energy from the coin and causing its subsequent movement to become more stable.

Such devices can be quite important, particularly in validators which are designed to be used with coins having a large size variation. In such validators, controlling the movement of small coins along paths which can accommodate large coins is difficult. Also, in view of the increasing tendency to make smaller validators, the distance between the point of entry of the coin and the testing section is becoming smaller, and therefore it is becoming more difficult to ensure that the coin's movement is stable before it reaches the testing section. Therefore, it would be desirable to provide a coin guiding device which ensures that coins adopt more reliably a consistent flight path.

SUMMARY OF THE INVENTION

According to a first aspect of the present invention there is provided a coin guiding device comprising a surface disposed normally in use in the path of a coin, which path has opposite sides each extending transverse to the plane of the coin, characterised in that the surface is inclined downwardly toward one of said opposite sides of the path so as to cause a coin which has engaged the surface to move toward that side, the device being arranged so that the surface moves thereafter in a direction out of the plane of the coin so as to permit the coin to pass.

According to a second aspect of the present invention there is provided a coin guiding device comprising a surface disposed normally in use in the path of a coin, which path has opposite sides each extending transverse to the plane of the coin, the surface being moveable under the weight of the coin in a direction out of the plane of the coin to permit the coin to pass, characterised in that the surface is inclined downwardly toward one of said opposite sides of the path to cause coins which have engaged the surface but not yet moved past it to tend to move toward that side, the surface being so arranged that the effective leverage caused by the coin increases as the coin moves toward that side.

Preferably, the surface is moveable out of the path of the coin under the weight of the coin. Preferably, the effectiveness of the weight of the coin in moving the surface increases as the coin moves toward the side of the path. As an alternative, it would be possible for the surface to be latched so that it cannot be moved until the latch is released, and for there to be means disposed at or adjacent the side of the path for releasing the latch when engaged by a coin which has rolled down the surface.

The device clearly has the advantage of absorbing some of the energy of the coin on impact, as in prior art devices. In addition, the device of the preferred embodiment tends to guide coins toward one side of the coin path, and will cause lighter (and smaller) coins to move further to that side of the path than the larger, heavier coins. As a consequence, all or most of the coins will be guided toward that side. Some of the larger coins may be capable of shifting the surface out of their path before they have moved toward the side of the path. However, such coins would have a size such that they are already located close to or in contact with the side, so no lateral repositioning is necessary. An added advantage of the device of the present invention is that the reaction force developed as the coin moves the surface out of its path will tend to cause the coin to move in a direction perpendicular to its plane. Thus, coins will tend to be guided not only close to the side of the path but also to a reference surface at the back of the path. (The term "back" is used herein merely to refer to the location of that side of the passageway which is on the opposite side of the coin from the surface of the coin guiding device as the coin moves past the surface. This is not intended by way of limitation, as clearly the actual orientation in use could vary.)

BRIEF DESCRIPTION OF THE DRAWINGS

An arrangement embodying the invention will now be described by way of example with reference to the accompanying drawings, in which.

DETAILED DESCRIPTION OF THE INVENTION

Figure 1:
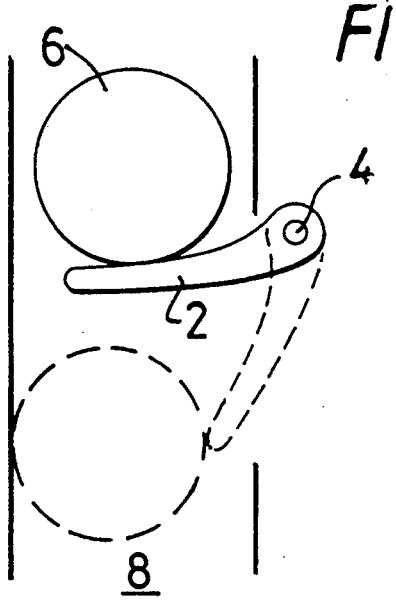
FIG. 1. PRIOR ART
FIG. 1 schematically illustrates a coin guiding device of the prior art.

In the exemplary prior art arrangement shown in FIG. 1, a coin guiding element 2 is biassed to the position shown in solid lines, but can be pivoted about a pin 4 to the position shown in phantom lines as a result of the impact of a coin 6 travelling along a coin passageway 8. The coin is thus allowed to pass the element 2 as shown in phantom. The impact with the element 2 will reduce the momentum of the coin, and the element would tend to guide coins towards the left of the passageway 8 as shown in FIG. 1.

Such an arrangement requires a large space to be provided to allow for the movement of the element 2. Also, it will be understood from FIG. 1 that a second coin which closely follows the coin 6 might not impact the element 2, because the latter may not have time to move back to the position shown in solid lines before the following coin reaches that position. Although there is a limited amount of guidance in the lateral direction, the overall control of the coin may be dependent upon the coin's diameter, weight, momentum, and its position across the width of the path, as it impacts the element 2. The design is unlikely to be useful for a very large range of coin diameters, and provides no guidance in the direction perpendicular to the plane of the drawing.

Figure 2:
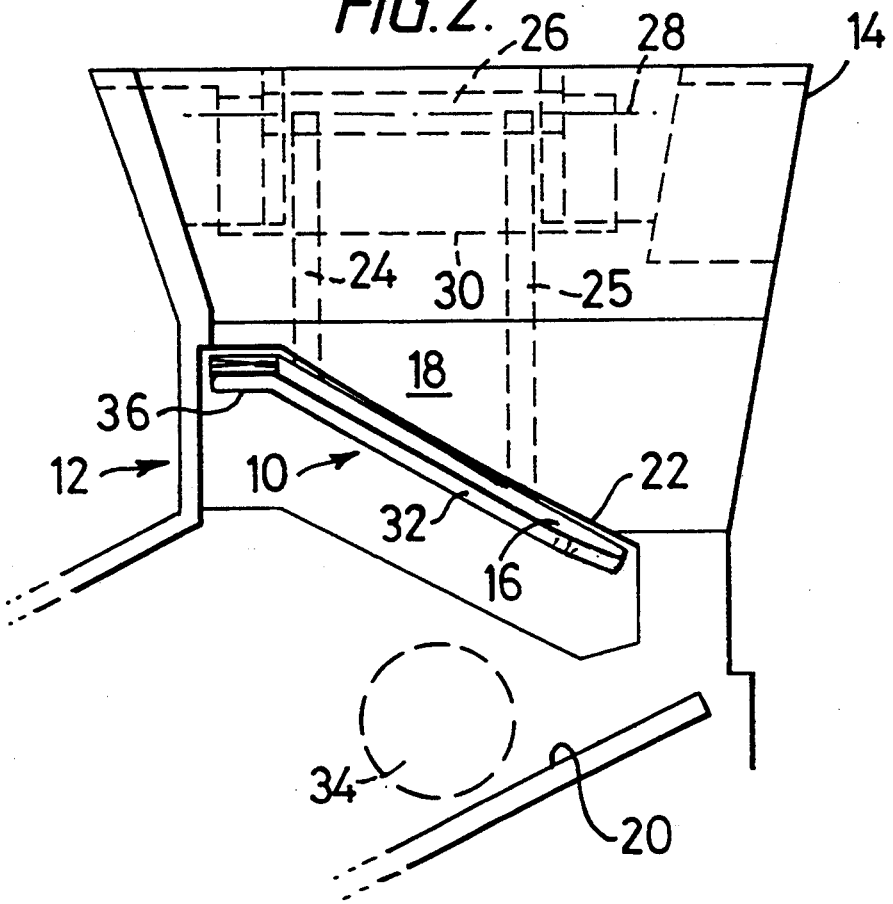
FIG. 2 schematically represents a rear elevation of part of a validator including a coin guiding device of the present invention.
Figure 3:
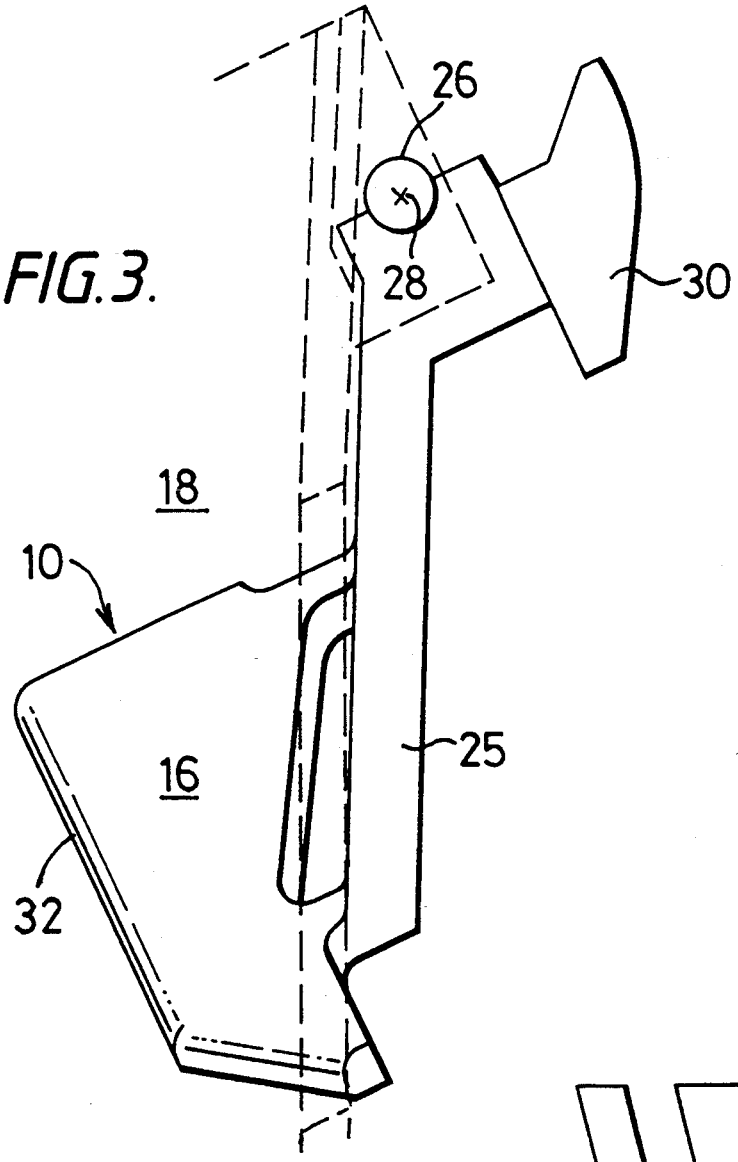
FIG. 3 is a side elevation of the coin guiding device of FIG. 2.
Figure 4:
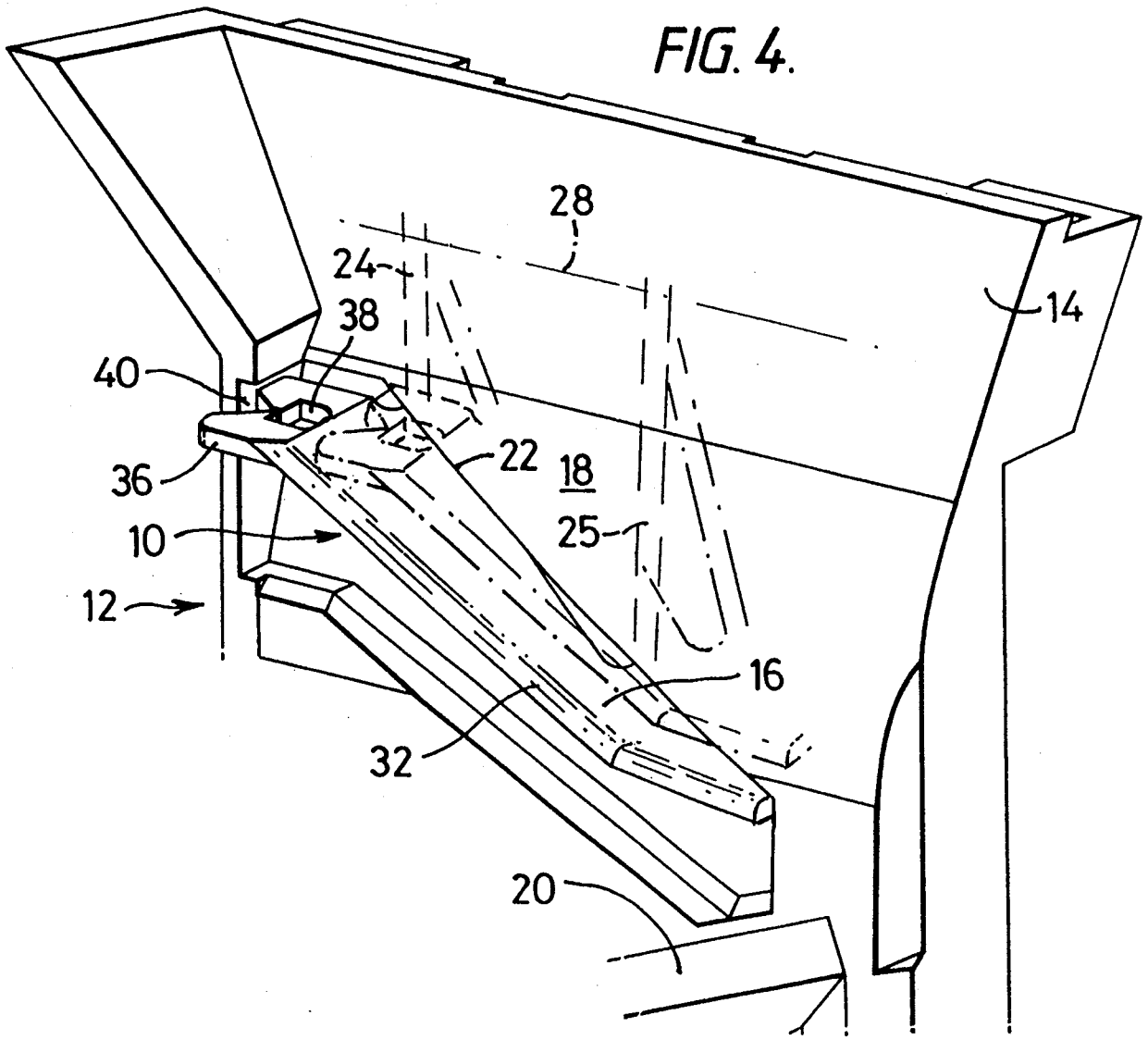
FIG. 4 is a perspective view showing the coin guiding device in the validator.

Referring to FIGS. 2 to 4, a coin guiding device 10 according to the present invention is mounted in a validator 12 immediately below the hopper 14 forming the entry to the validator. The device comprises a ledge 16 which extends across the width of the coin passageway 18 leading from the hopper mouth 14 to a ramp 20.

The ledge 16 projects through an aperture 22 in the front wall of the validator deck into the passageway 18. At the front of the deck, the ledge 16 is coupled via two arms 24,25 to a pivot member 26 by means of which the device 10 is mounted for pivotal movement about an axis 28 which is substantially horizontal, and which is located in front of the passageway 18 and in a plane which is substantially parallel to the plane of The passageway 18. The coin guiding device also includes a counterweight 30 disposed at the front of the pivot axis 28, and of sufficient weight to cause the ledge 16 to project into the passageway as shown in FIGS. 2 and 3.

The ledge 16 is inclined downwardly toward the right-hand side of the passageway 18 as shown in FIG. 2, and to accommodate this the left-hand arm 24 linking the ledge 16 to the pivot member 26 is shorter than the right-hand arm 25. It will be further noted that the ledge 16 has an upper surface which extends downwardly from the front of the passageway 18 to the back of the ledge. The back edge 32 of the ledge 16 is curved as shown mostly clearly in FIGS. 2 and 3.

A coin entering the hopper 14 will engage the upper surface of the ledge 16. Because the ledge 16 is inclined downwardly from the front of the passageway toward the rear, there will be a reaction force tending to pivot the ledge 16 forwardly about the axis 28. The force will be dependent upon the point of impact. The force will tend to be greater as the point of impact moves toward the right as shown in FIG. 2, because the distance between the point of impact and the pivot axis 28 increases in this direction. Accordingly, if the coin is not sufficiently heavy to pivot the ledge 16, it will tend to roll down the ledge toward the right-hand side until the additional torque produced by the increased distance between the point of engagement and the pivot axis is sufficient to produce movement of the ledge 16. At this time, the ledge pivots towards the front, and the coin slips past the ledge so that it can then roll down the ramp 20. This is facilitated by the curvature of the back edge 32.

Referring to FIG. 4, this shows how the device 10 may move from the position shown in solid lines to the position shown in phantom. Any large, heavy coins entering the hopper will tend to shift the ledge 16 cut of the way. The impact with the ledge will reduce the momentum of the coins, but there will not be any substantial shifting of the position of the coin laterally within the passageway 18, because the ledge 16 will move out of the way before the coin rolls substantially down the ledge toward the right. However, this is unimportant for large coins, because the relationship between the coin diameter and the width of the passageway 18 is such that there is not a substantial variation in the lateral position and therefore the movement tends not to be particularly erratic. Any small, light coins, however, would normally exhibit very erratic movement. However, with the device of the present invention, such coins will not be capable of pivoting the ledge 16 unless they impact the ledge at the right-hand side, or unless they impact the ledge at a higher position and then roll down toward the right-hand side.

It has been found in practice that the device 16 causes all inserted coins to fall onto the ramp 20 at or very close to the highest possible point on the ramp. Accordingly, it is possible to put a testing coil, such as that shown at 34 in FIG. 2, adjacent the top of the ramp 20. Accuracy in measurement is achieved because the smaller coins are guided fully into the testing section.

The tendency of the ledge 16 to move rearwardly, away from the front surface of the passageway 18, under the force of the counterweight 30 has the added advantage that coins will tend to be pushed toward the rear surface (not shown) of the passageway, so that the device controls the coin flight not only across the passageway but also in the perpendicular direction (i.e. in the direction normal to the plane of FIG. 2) to deliver the coin to ramp 20 in a proper position for testing and validation by the testing coil. The entire validator structure is inclined in use so that the upper part is tilted rearwardly, so that coins tend to travel with one surface in engagement with the rear surface of the passageway. This tendency is enhanced by the use of the device 10, which will dampen any bouncing of the coin.

It will be noted that the ramp 20 extends downwardly to the left in FIG. 2. At the upper, left-hand side of the ledge 16 there is provided a string-catcher 36. This is in the form of an aperture 38 (see FIG. 4) with a narrow mouth, and a tapered slot 40 leading to the mouth. Because the coins move to the left as shown in FIG. 2, it is ensured that any string attached to the coin which is held by a user who is attempting the well-known coin-on-a-string fraud will also move to the left, and when the user attempts to retrieve the coin by pulling the string the latter will enter the recess 38. This will effectively prevent the coin from being returned because the user will not be able to pull it past the ledge 16.

Figure 5:
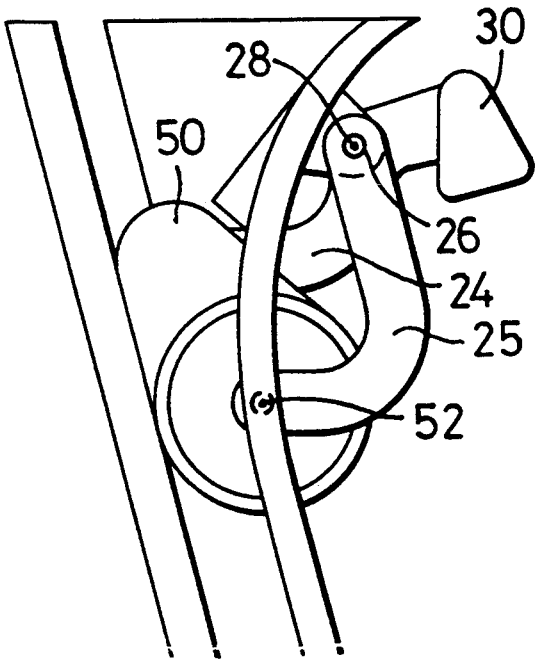
FIG. 5 illustrates a modification of the device.

In the modification shown in FIG. 5 (wherein reference numbers corresponding to those in FIGS. 2 to 4 relate to corresponding elements), the ledge 16 is replaced by a roller 50. The roller is mounted for rotation about an axis 52 which extends across the passageway. The roller may be cylindrical or, as shown in the drawings, may have a frusto-conical surface. In any event, the relationship between the pivot axis 28 of the device, the axis 52 of rotation of the roller 50, and the surface of the roller are such that the force tending to push the roller bodily out of the way increases as the point of engagement between the coin and the roller moves toward the side of the passageway. Accordingly, the action is similar to that of the embodiment of FIGS. 2 to 4, although use of the roller facilitates the movement of the coin past the device.

A passive snubber may additionally be provided beneath the device so as further to absorb energy from the moving coin.

It would be possible for the movement of the device to be used to generate an electrical signal, either by operating a mechanical switch or using optical or inductive sensors or the like, so that the device can serve the additional function of detecting the arrival of coins. This detection can be used for various purposes, e.g. the powering up of selected sections of the validator.

Other forms of biassing than a counterweight (e.g. a spring) could be used.

I claim:

1. Apparatus comprising a coin validator operable to validate coins of a plurality of denominations and a coin guiding device arranged upstream of said coin validator, the coin guiding device comprising a moveable ledge surface disposed in a path of a coin traveling substantially in its own plane and a reference surface extending parallel to the plane of the coin, the ledge surface being inclined downwardly toward a side of the path so as to cause a coin which has engaged the ledge surface to move substantially in its own plane toward the side, the device being arranged so that the ledge surface moves thereafter in a direction out of the plane of the coin so as to permit the coin to pass toward the path side and substantially against the reference surface, wherein coins of all denominations are delivered to the device and engage the ledge surface, are thereby stabilized and delivered to the validator.

2. An apparatus as claimed in claim 1, wherein the ledge surface has an edge engaged by the coin as the coin moves past the ledge surface, and wherein said edge is curved to facilitate the movement of the coin past the ledge surface.

3. An apparatus as claimed in claim 1 including a string catcher arranged to move with the ledge surface.

4. An apparatus as claimed in claim 1 including means for generating an electrical signal in response to movement of the ledge surface.

5. Apparatus comprising a coin validator, and a coin guiding device arranged upstream of said coin validator, the coin guiding device comprising a moveable ledge surface disposed normally in use in the path of a coin and a reference surface extending parallel to a plane of the coin, the ledge surface being moveable under the weight of the coin in a direction out of the plane of the coin to permit the coin to pass substantially against the reference surface, wherein the ledge surface is inclined downwardly toward a side of the path to cause a coin which has engaged the ledge surface but not yet moved past it to tend to move substantially in its own plane toward the side, the surface being so arranged that the effective leverage caused by the coin increases as the coin moves toward the side so as to move the ledge surface and permit the coin to pass toward the side and substantially against the reference surface such that all coins engaging the ledge surface are stabilized and thereafter delivered to the validator.

6. An apparatus as claimed in claim 5, wherein the device is pivotably mounted with respect to the path.

7. An apparatus as claimed in claim 6, wherein the ledge surface extends in a direction at an angle to the pivot axis such that the distance between the axis and the ledge surface increases toward said side of said path.

8. An apparatus as claimed in claim 6, wherein the pivot axis is disposed in a plane substantially parallel to the plane of the coin path and in a direction substantially parallel to the width of the coin path.

9. An apparatus as claimed in claim 5, wherein the ledge surface is additionally inclined with respect to the plane of the coin so that the engagement of the coin with the ledge surface provides a reaction force transverse to the path of the movement such as to cause the device to move out of the plane of the coin.

10. An apparatus as claimed in claim 5, including a counterweight for biassing the device into its normal position.

11. An apparatus as claimed in claim 5, wherein the device includes a roller arranged to rotate about an axis transverse to the coin path, said ledge surface being formed by the roller and the arrangement being such that engagement of the coin with the ledge surface produces a force tending both to shift the roller transversely out of the path of the coin and to rotate the roller.

12. An apparatus as claimed in claim 5, wherein the ledge surface has an edge engaged by the coin as the coin moves past the ledge surface, and wherein said edge is curved to facilitate the movement of the coin past the ledge surface.

13. An apparatus as claimed in claim 5 including a string catcher arranged to move with the ledge surface.

14. An apparatus as claimed in claim 5 including means for generating an electrical signal in response to movement of the ledge surface.

15. A coin handling apparatus for handling a set of coins of different denominations, the apparatus comprising a coin guiding device and means for directing all coins within the coin set to the coin guiding device, said coin guiding device being operable to guide all coins of the coin set to a validator, said coin guiding device comprising a moveable ledge surface disposed in a path of said coins and a reference surface extending parallel to a plane of the coins, the ledge surface being moveable under the weight of the coins in a direction out of the plane of the coins to permit the coins to pass substantially against the reference surface, wherein the ledge surface is inclined downwardly toward a side of the path to cause coins which have engaged the ledge surface but not yet moved past it to tend to move toward the side, the ledge surface being so arranged that the effective leverage caused by the coin increases as the coin moves toward the side so as to move the ledge surface and permit the coins to pass toward the path side and substantially against the reference surface, wherein lighter coins within the coin set move further on the ledge surface toward the side than heavier coins.

16. A method of guiding the passage of coins of a plurality of denominations to a coin validator in a coin handling apparatus, the method comprising:

directing inserted coins to a coin guiding device, wherein the coin guiding device comprises a moveable ledge surface disposed in a path of a coin and a reference surface extending parallel to a plane of the coin;

moving the ledge surface under the weight of the coin in a direction out of the plane of the coin to permit the coin to pass substantially against the reference surface, wherein the ledge surface is inclined downwardly toward a side of the path to cause coins which have engaged the surface but not yet moved past it to tend to move toward the side; and increasing an effective leverage caused by the coin as the coin moves toward the side so as to move the ledge surface and permit the coin to pass toward the path side and substantially against reference surface, wherein lighter coins are caused to move further on the ledge surface toward the side than heavier coins to stabilize the coins for validation by the validator.

* * * * *